US005407339A

United States Patent [19]

Fehlhafer

[11] Patent Number: 5,407,339

[45] Date of Patent: Apr. 18, 1995

[54] TRITURATE TABLET MACHINE

[75] Inventor: Jeffrey E. Fehlhafer, Cedar Rapids, Iowa

[73] Assignee: Vector Corporation, Marion, Iowa

[21] Appl. No.: 126,643

[22] Filed: Sep. 27, 1993

[51] Int. Cl.[6] ..... B30B 11/10

[52] U.S. Cl. ..... 425/106; 425/100; 425/226; 425/228; 425/324.1; 425/345; 425/361

[58] Field of Search ..... 425/90, 100, 106, 226, 425/228, 259, 324.1, 344, 345, 353, 361

[56] References Cited

U.S. PATENT DOCUMENTS

| | | | |
|---|---|---|---|
| 304,283 | 8/1884 | Sword et al. | 425/345 |
| 308,508 | 11/1884 | McFerran | 425/91 |
| 332,494 | 12/1885 | Coles | 425/228 |
| 387,002 | 7/1888 | McFerran | 424/228 |
| 1,171,301 | 2/1916 | Baird | 425/90 |
| 1,550,821 | 8/1925 | King | 425/100 |
| 2,735,380 | 2/1956 | Bowes | 425/107 |
| 2,838,802 | 6/1958 | Reynolds et al. | 264/122 |
| 3,029,752 | 4/1962 | Frank | 425/107 |
| 3,158,111 | 11/1964 | Raff | 264/304 |
| 3,461,195 | 8/1969 | Sebastiani | 264/109 |
| 3,726,622 | 4/1973 | DeTroyer et al. | 425/193 |
| 4,047,866 | 9/1977 | Shah | 425/107 |
| 5,017,122 | 5/1991 | Staniforth | 425/100 |

*Primary Examiner*—James P. Mackey
*Attorney, Agent, or Firm*—Hill, Steadman & Simpson

[57] ABSTRACT

A triturate tablet machine for molding wet powder tablets which has five processing stations which respectively supply wet powder, mold the wet powder into openings in a mold plate, lubricate both ends of the tablets, bevel each end of the tablets and eject the tablets so as to continuously and automatically manufacture wet powder tablets.

13 Claims, 6 Drawing Sheets

TRITURATE TABLET MACHINE

BACKGROUND OF THE INVENTION

1. Field of the Invention

This invention relates in general to tablet manufacturing machines and in particular to a triturate tablet machine.

2. Description of Related Art

A "triturate" is a pharmaceutical solid dosage form that is molded from a semi-wet powder and then dried. It is desirable to form a dosage when very quick dissolution is required such as a sublingual (under the tongue) type medication such as a nitroglycerin heart medicine. In the prior art, since the "triturate" is formed as a semi-wet powder tablet which is dried, all triturates have been molded in a true cylindrical shape. Since the semi-wet powder tends to stick to molding punch faces, it has always been accepted that only cylindrical shapes could be produced. Triturate tablets are always quite fragile and the sharp edges of the cylinder tend to break off. See also U.S. Pat. Nos. 4,047,866, 5,017,122, 308,508, 3,158,111, 3,461,195, 2,735,380 and 3,029,752.

SUMMARY OF THE INVENTION

The present invention comprises an automatic triturate tablet machine which produces triturates tablets with beveled edges and has a beveling station that utilizes upper and lower punches to mold the bevel on both ends of the cylindrical shape tablet. The invention also provides a powder lubricant releasing station so as to dust both ends of the cylindrical tablet of powder before it reaches the beveling station which allows the beveling operation to occur without the semi-wet powder sticking in the concave beveling punches.

The invention comprises a molding plate formed with a number of tablet molding openings which is intermittently rotated so as to pass various stations. A powder feed station supplies the wet powder to the molding plate and into holes of the molding plate. A tablet molding station spreads the wet powder into the holes of the molding plate and forces the wet powder into the holes of the molding plate. A powder releasing station blows dry powder onto the top and bottom of the holes in the molding plate so as to lubricate the material in the holes of the plate.

A beveling station has upper and lower bevel punches which bevel the tablets in the holes of the molding plate. An ejector station ejects the tablets from the mold plate where they are supplied to a conveyor which removes the tablets from the molding machine. Wiper arms clean the beveling and ejector punches and are periodically moved so as to respectively engage the beveling and ejector punches to clean them and a control operates the molding plate drive means and controls each of the molding stations so as to operate the machine.

It is a feature of the present invention to provide a novel tablet molding machine for wet powder molding which may have a consistency of dough so that tablets may be beveled and formed without breakage.

It is an object of the invention to provide a novel triturate tablet molding machine.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DETAILED DESCRIPTION OF THE PREFERRED EMBODIMENTS

The triturate tablet molding machine of the present invention has a rotatably driven molding plate which is formed with a number of molding holes which is intermittently driven by a motor and is locked in fixed angular position by a plate locating means such as a plate locating pin that indexes and locks the molding plate by engaging holes formed adjacent the periphery of the plate. A powder feed station supplies semi-wet powder to the top surface of the molding plate and a flexible cable drives a powder agitator which discharges the powder to a powder shuttle which is controlled by a pneumatic cylinder so as to extend it and distribute wet powder over and into the holes of the molding plate. A tablet molding station provides for spreading the powder into the plate holes and has a spreader which rotates and moves vertically so as to introduce wet powder into the holes of the molding plate.

A further station comprises a powder releasing station wherein lubricating powder is blown onto the top and bottom of the holes of the molding plate so as to lubricate the top and bottom ends of the material in the holes of the plate. A beveling station has upper and lower concave dies which move to engage the material in the holes of the molding plate so as to form bevels on both ends of the tablets. An ejector station has punches which move into the tablet molding plate so as to eject the molded tablets onto a conveyor where they are removed from the machine. Wiper arms 19 and 21, respectively, clean the beveling and ejector punches by periodically moving over them.

A control is connected to the stations of the molding machine and to the motor which drives the molding plate as well as to the locking pin control for the plate and the other actuated elements of the various mold plate stations.

Figure 1:
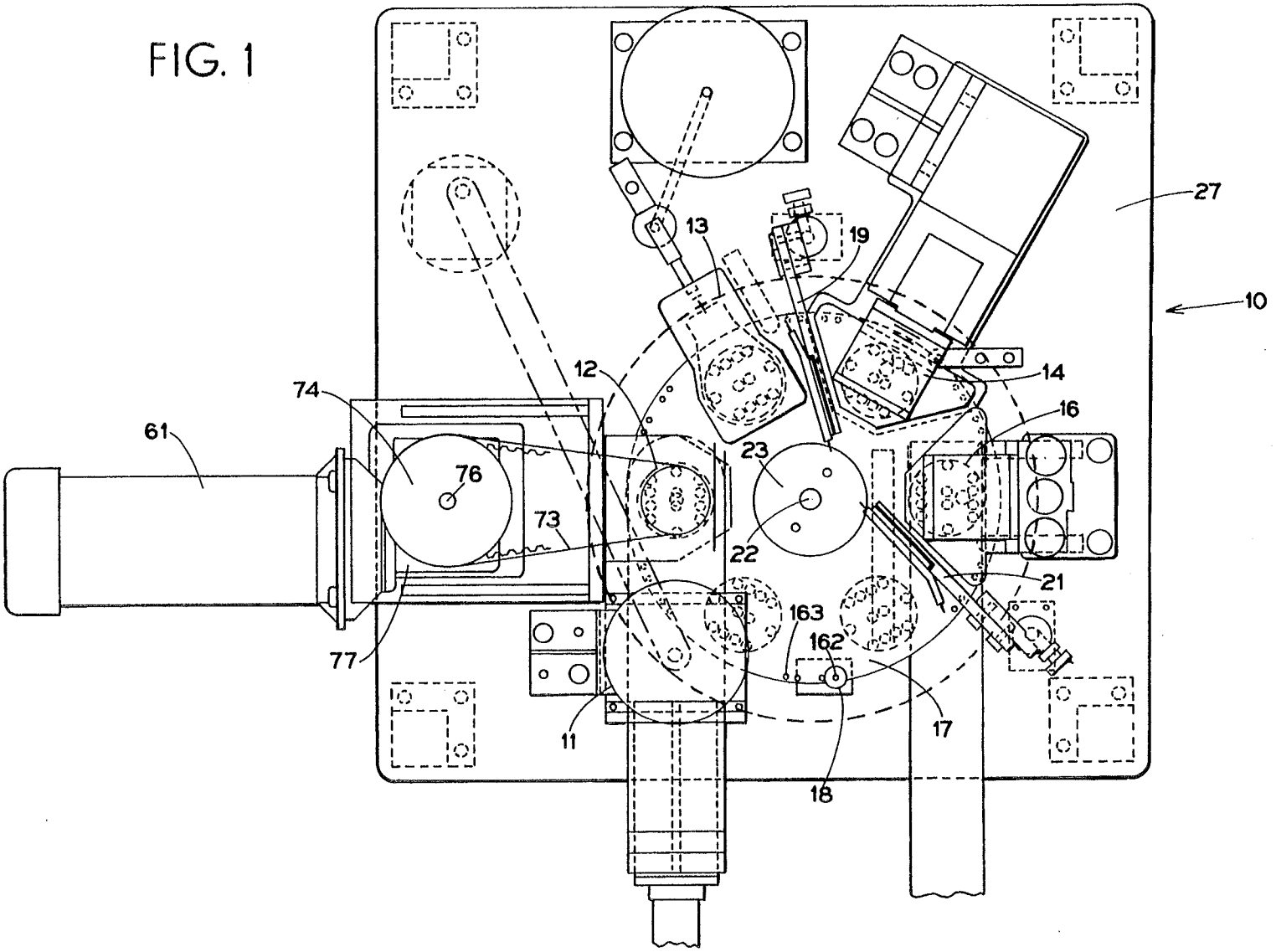
FIG. 1 is a top plan view of the invention.
Figure 4:
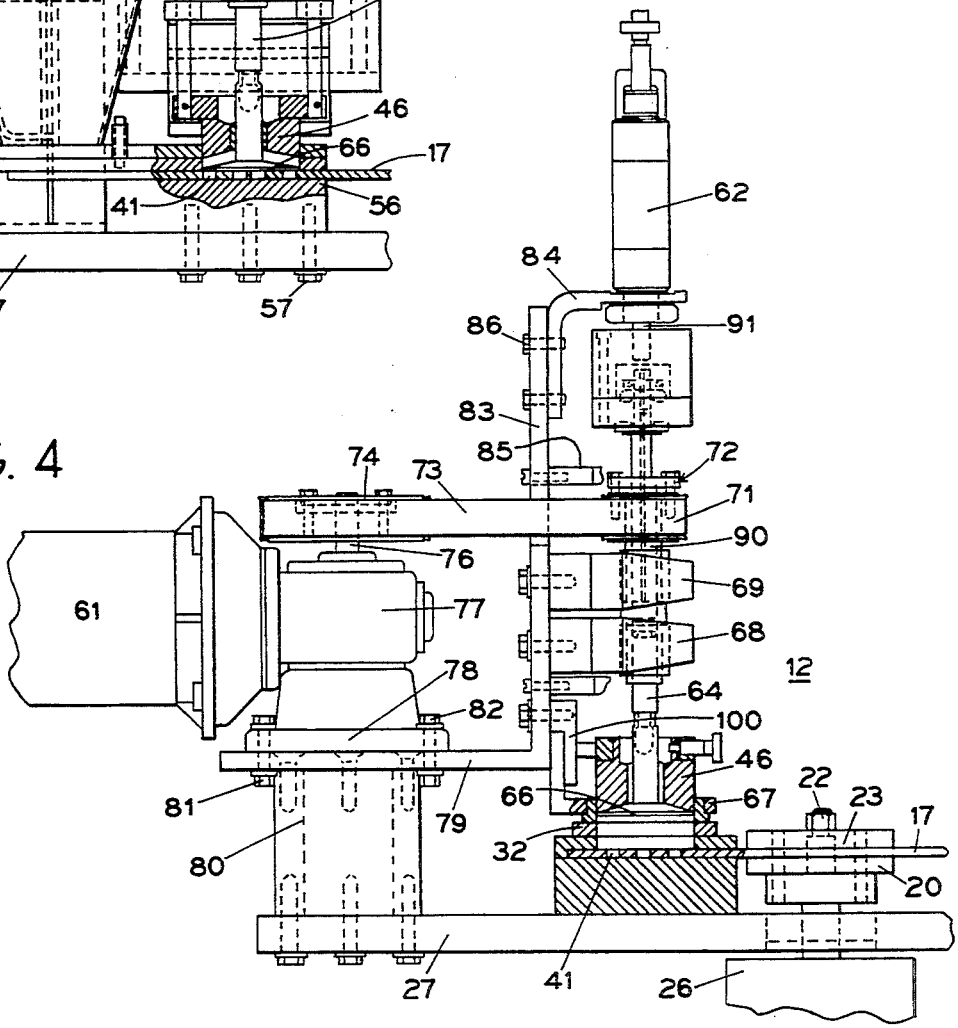
FIG. 4 is another view of the tablet molding station.
Figure 9:
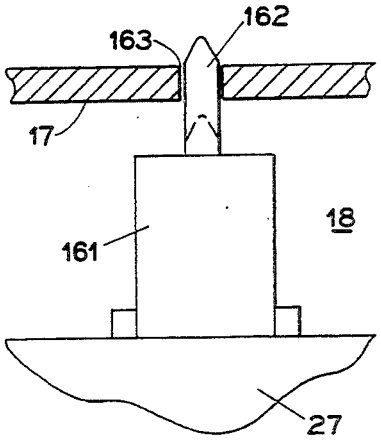
FIG. 9 illustrates the indexing means.

FIG. 1 is a top plan view of the molding machine 10 of the invention. A planar frame member 27 rotatably supports a molding plate 17 which is mounted on a shaft 22 that is driven by a motor 26 as illustrated in FIG. 4. The motor 26 is mounted on the frame plate 27 and the mold plate 17 is mounted on shaft 22 between disks 20 and 23. As shown in FIGS. 1 and 9 a plurality of index holes 163 are formed about the periphery of the mold plate 17 and a locking pin 162 is controlled by a solenoid 161 as shown in FIG. 9 so as to lock the molding plate in predetermined angular positions. The locking pin 162 and solenoid 161 comprise a locking means 18 for intermittently locking the plate 17 in predetermined angular positions. In the clockwise direction from the locking means 18 is mounted a power feed station 11 after which a tablet molding station 12 is mounted. Adjacent the tablet molding station 12 there is provided a lubricating station 13. Adjacent the lubricating station 13 is movably mounted a wiper arm 19 which is supported from the frame member 27 and the wiper arm 19 is periodically moved to clean beveling punches of a beveling station. Adjacent the wiping arm 19 a beveling station 14 is provided. Adjacent the beveling station 14 an ejector station 16 is provided for ejecting the finished tablets onto a conveyor 171 illustrated in FIG. 10. A wiper arm 21 is movably mounted between the ejector station 16 and the plate locating locking means 18 and the wiper arm 21 is periodically moved so as to clean the punch ejectors of the ejector station.

Figures 2, 12:
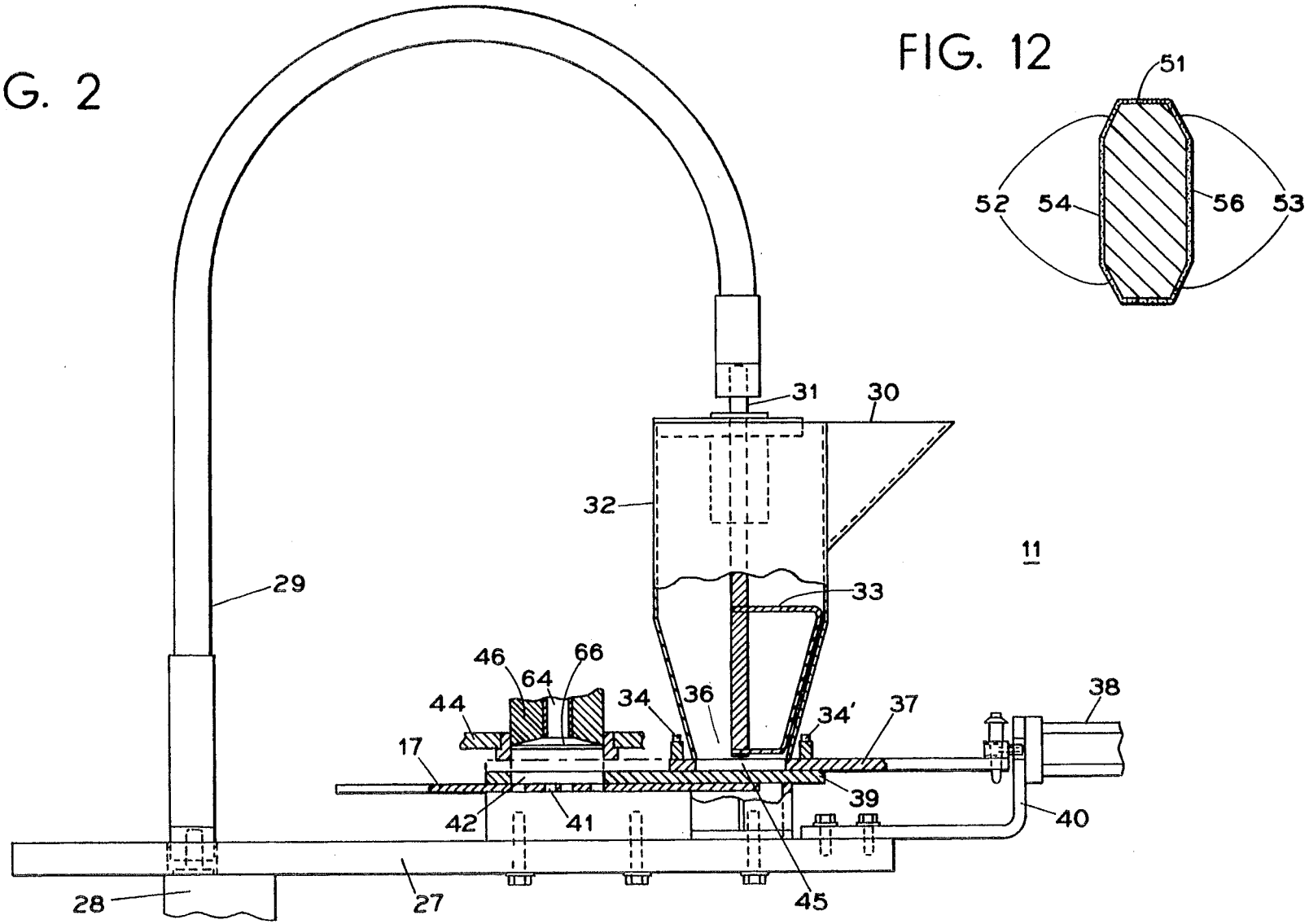
FIG. 2 is a side plan partially cut-away view of the powder feed station.
FIG. 12 is a sectional view illustrating a triturate tablet formed according to the invention.

FIGS. 2 and 1 illustrate the powder feed station 11 which comprises an agitator motor 28 which is mounted on the frame member 27 and is connected by a flexible drive 29 to a powder agitator 33 which has an output shaft 31 that is connected to the flexible drive 29 of the agitator motor 28. A hopper 32 is supplied with wet powder through a feed opening 30 and opening 36 in the bottom of hopper 32 supplies wet powder to a powder shuttle 37 which is moveably driven by pneumatic cylinder 38 mounted on a bracket 40 connected to the frame member 27. The powder shuttle 37 is formed with an opening 45 such that when the powder shuttle 37 is in the right position relative to FIG. 2, powder from the hopper 32 will pass through the opening 36 into the opening 45 of the powder shuttle. Upper guides 34 and 34' rest against the upper surface of the powder shuttle and a bottom plate 39 is attached to the frame member 27 and is fixed thereto such that the powder shuttle 37 can move relative to the support plate 39. When the cylinder 38 is actuated, the powder shuttle 37 moves to the left to the dash-dot position shown in FIG. 2 so that the opening 45 is aligned with an opening 42 formed in the lower support plate 39 and with a plurality of openings 41 formed in the molding plate 17. A powder feed cup 46 is guided by frame member 44 in the tablet molding station 12 and a tablet molding spreader is mounted on a shaft 64 and is rotatably and moveable vertically relative to FIG. 2 so as to push wet powder through the openings 45 and 42 into the openings 41 of the mold plate 17.

Figure 3:
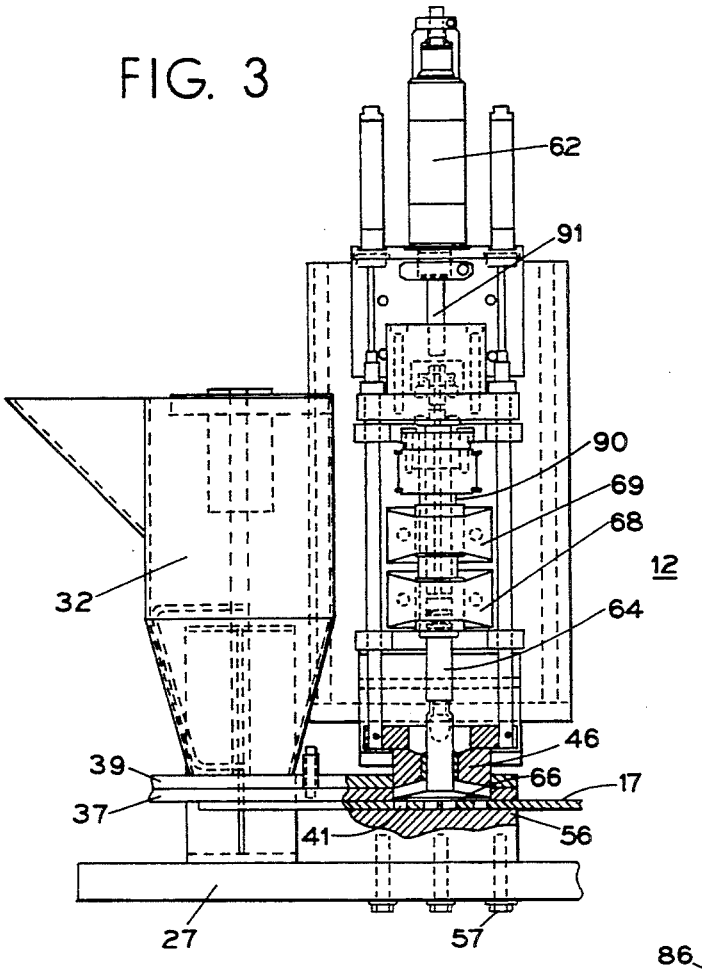
FIG. 3 is a partially sectional view of the tablet molding station.

FIGS. 3 and 4 illustrate in greater detail the tablet molding station 12. A spreader drive motor 61 is connected to a gear box 77 which has an output shaft 76 that drives a pulley 74. A belt 73 engages the pulley and also engages the pulley 71. The pulley 71 is connected to a bracket 72. A bracket 85 extends from a frame member 83 connected to the support member 80 by bolts 81. The support member 80 is connected to the frame member 27 and the portion 79 of the frame member 83 as illustrated. The sleeve shaft 90 is driven by the belt 73 and the pulley 71 and the shaft 90 is connected to the shaft 64 which drives the molding spreader 66. The molding spreader has a member 46 through which the shaft 64 extends and the tablet molding spreader 66 is rotatable and is moveable vertically relative to the powder feed cup 46 which is connected to the frame member 83 by a support 100. A solenoid spreader cylinder 62 is connected to shaft 91 and is mounted on the bracket 84 which is connected by bolts 86 to the frame member 83 and when actuated drives the powder feed cup 46 to the down position which is shown in FIG. 3 so as to force powder into the openings 41 of the mold plate 17. Brackets 68 and 69 extend from the frame member 83 and support the collar shaft 90 as shown in FIGS. 3 and 4. FIG. 3 illustrates the molding spreader 66 in the down position with the spreader cylinder 62 energized so as to move the shaft 91 downwardly, thus extending the powder feed cup 46 and molding spreader 66 downwardly to force the wet powder into the openings 41 of the mold plate 17. The motor 61 and belt 73 drive the sleeve shaft 90 so as to rotate the shaft 64 and molding spreader 66.

Figure 5:
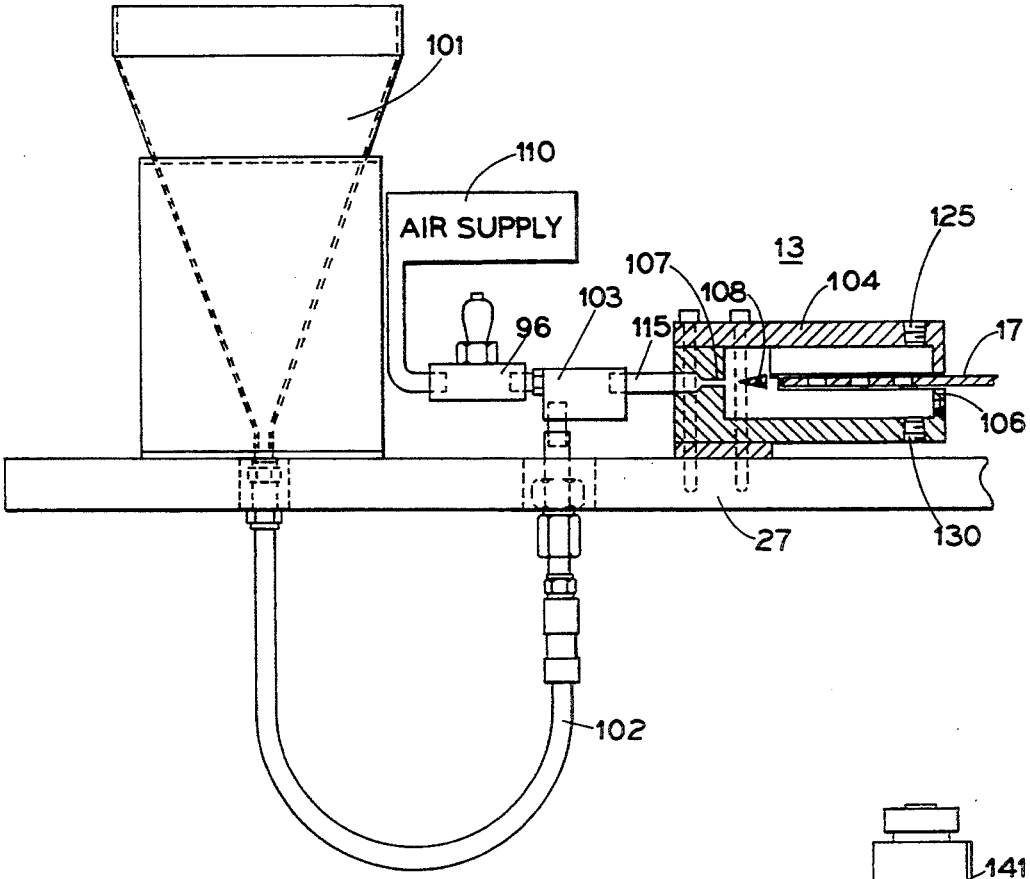
FIG. 5 is a partially sectional view of the lubricating station.

FIG. 5 illustrates the powder lubricating station 13 and includes a hopper 101 mounted on the frame 27 which has a lower outlet connected to a tube 102 which supplies powder to a vacuum transducer 103. An air supply 110 supplies dry air as, for example, at 60 psi minimum pressure to a flow control valve 96 which supplies air to the vacuum transducer 103. An output tube 115 from the vacuum transducer 103 supplies powder from the hopper 101 through an orifice 107 in a lubricating chamber or shoe 104 which is mounted on the frame member 27. A wedge 108 is supported in the lubricating chamber 104 by support means, not shown, so as to direct lubricating powder on opposite sides of the mold plate 17 which passes into the lubricating chamber 104 through a slot 106. Ventilation holes 125 and 130 are formed on opposite sides of the mold disk 17 in the lubricating chamber 104.

Figure 6:
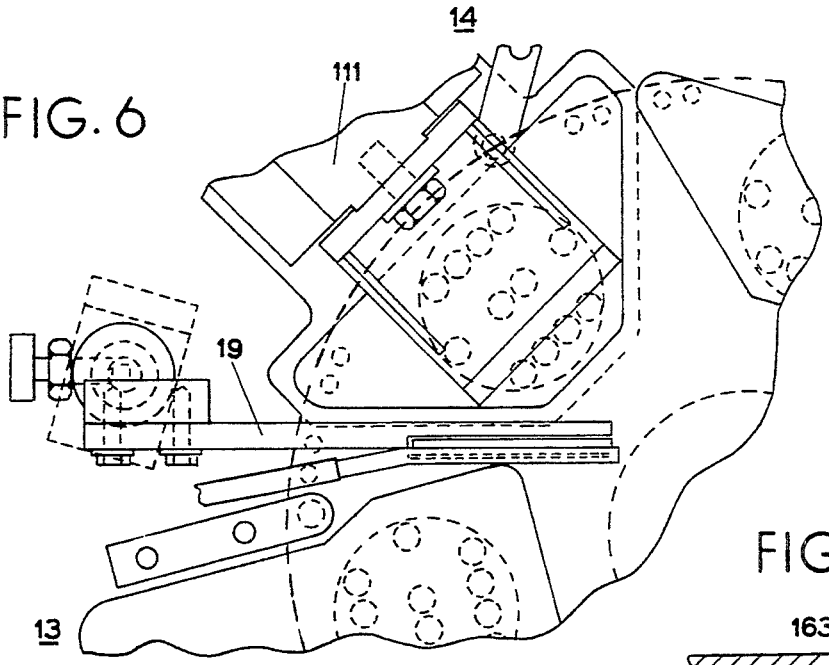
FIG. 6 is a top plan view of the beveling station.
Figure 8:
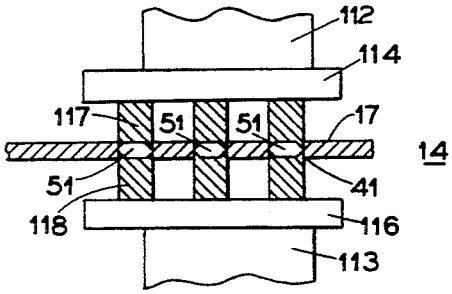
FIG. 8 is a detail view of the beveling station.
Figure 7:
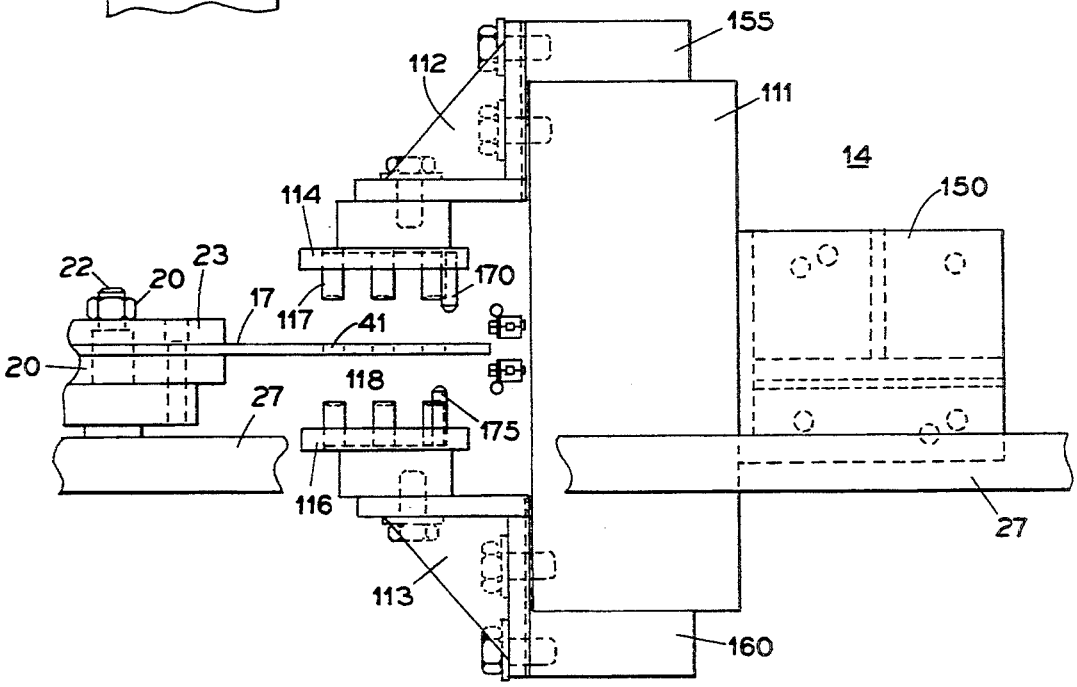
FIG. 7 is a side view of the beveling station.

FIGS. 6, 7 and 8 illustrate the beveling station 14. A parallel jaw gripper pneumatic actuator 150 is mounted on the frame member 27 as shown in FIG. 7 and drives a couple of jaws 155 and 160 mounted in a member 111. The member 155 is connected to a bracket 112 which carries an upper bevel punch plate 114 which has a number of downwardly extending concave beveling punches 117 mounted thereon. A guide pin 170 extends from upper bevel punch plate 114 and is received in a mating opening in the mold plate 17. The moveable member 160 is connected to a bracket 113 which supports a lower bevel punch plate 116 which carries a number of lower beveling punches 118 which have concave ends. A guide pin 175 is received in an associated opening in the molding plate 17. As shown in FIG. 8, when the pneumatic actuator of the parallel jaw gripper 150 is actuated it moves the members 155 and 160 toward each other such that the upper beveling punches 117 and the lower beveling punches 118 move into the openings 41 of the mold plate 17 so as to form bevel edges on tablets 5i from the powder in the mold plate 17 as shown in FIG. 8. After the beveling operation has been completed, the pneumatic parallel jaw gripper 150 moves the members 155 and 160 apart so that the punches 117 and 118 move out of the mold plate 17.

Figure 10:
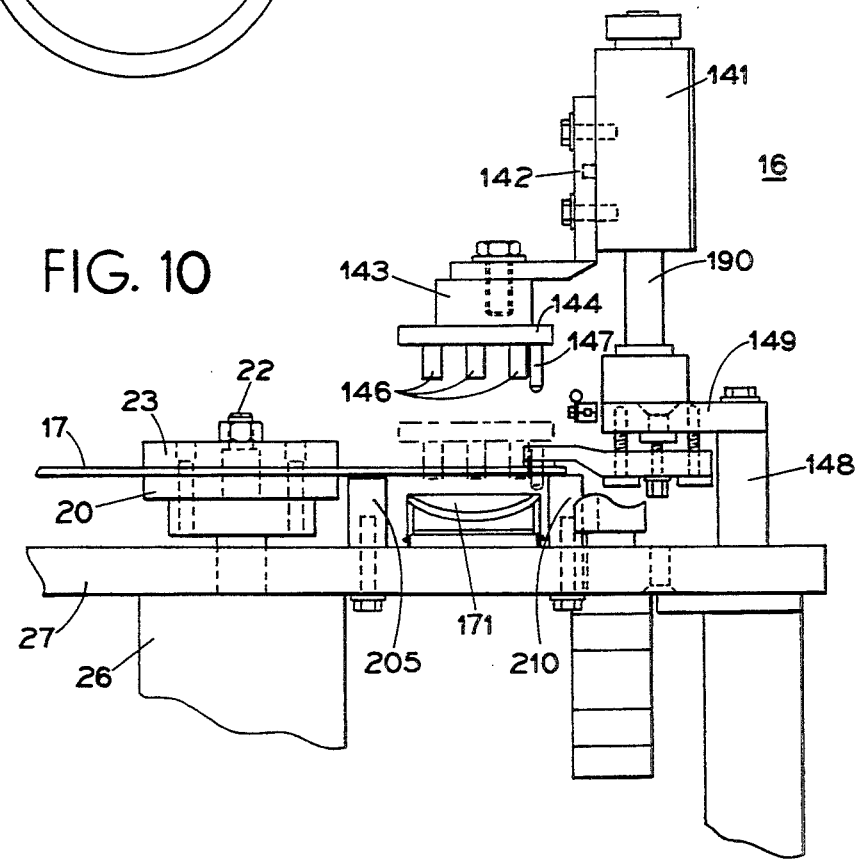
FIG. 10 is a view of the eject station.

After the beveling station 14, the ejector station 16 is mounted on a frame member 148 which is connected to the frame member 27 and supports a horizontal member 149 as shown in FIG. 10. A shaft 190 extends upwardly from the member 149 and a pneumatic slide 141 is mounted thereon. A bracket 142 is mounted on slide 141. A bracket 142 is connected to a support 143 which carries a punch ejector plate 144 upon which a plurality of pill removing punches 146 are mounted. A guide pin 147 is receivable in a mating opening in the mold plate 17. When the pneumatic slide 141 is actuated, the punches 146 move downwardly to the dash-dot position shown in FIG. 10 and the punches eject the tablets 51 from the openings 41 in the mold plate 17 onto a moveable conveyor 171 which removes the tablets from the machine. A pair of mold plate lower supports 205 and 210 slidably support the mold plate 17 so that the punches 146 do not distort or deform the mold plate 17. After the tablets are ejected, the pneumatic slide 141 moves the punches 146 to the position shown in FIG. 10 in solid line.

FIG. 12 illustrates a tablet 51 which has opposite sides 54 and 56 and bevels 52 and 53 respectively formed on the sides 54 and 56.

Figure 11:
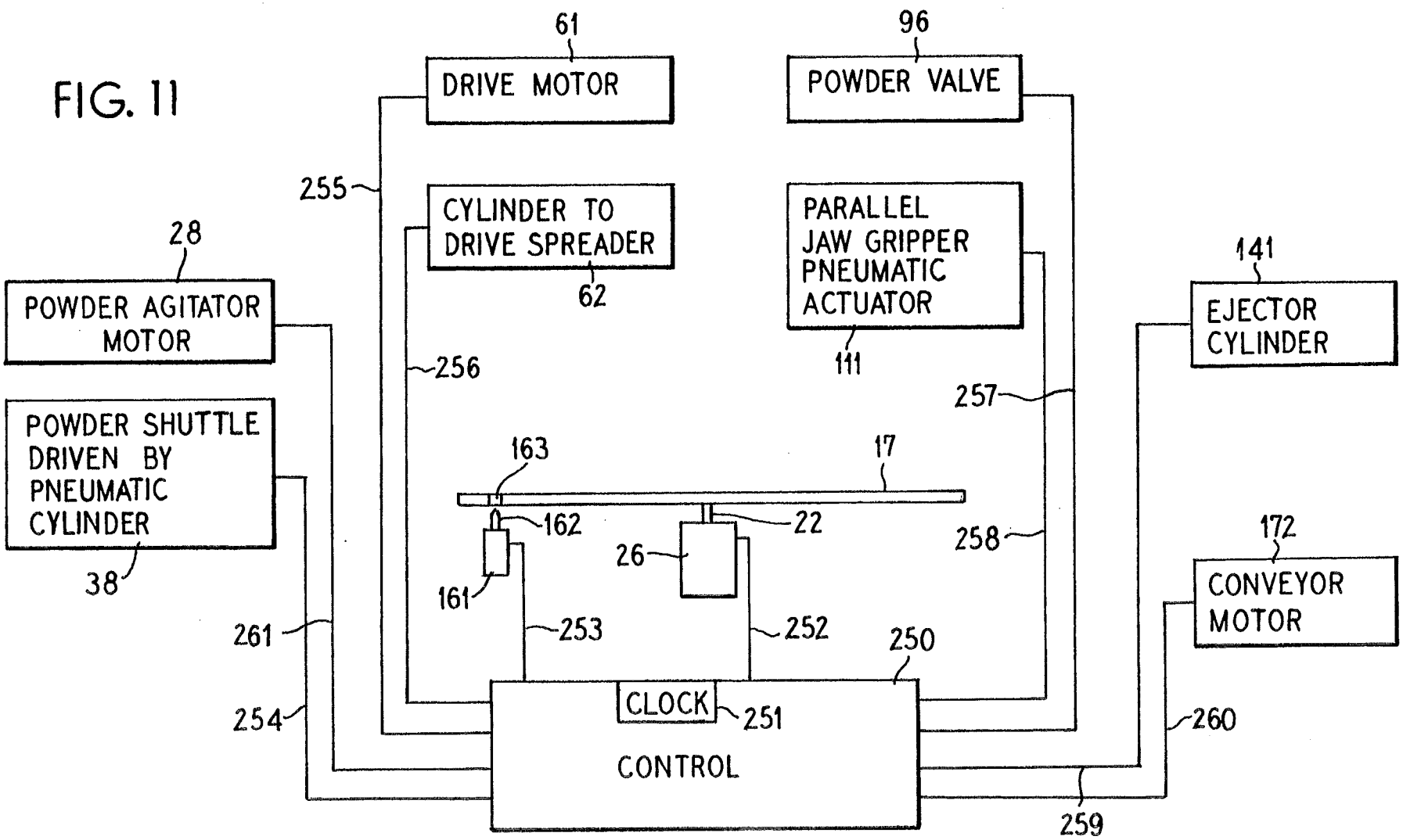
FIG. 11 is a schematic view of the control mechanism for the machine of the invention.

FIG. 11 illustrates the control of the invention. The control 250 has a clock 251 and supplies an output on lead 252 to periodically drive the mold plate drive motor 26 so as to move the mold plate 17. Control 250 also supplies an output on lead 253 to the solenoid 161 to control the locking pin 162 so as to lock and unlock the mold plate 17. The control 250 also supplies an output on lead 261 to the powder agitator motor 28 to drive it and also an output on lead 254 to drive the pneumatic cylinder 38 which drives the powder shuttle. An output on lead 255 from the control 250 is connected to the spreader drive motor 61 and an output on lead 256 is connected to the cylinder 62 which drives the spreader.

An output from lead 257 to the powder valve 96 actuates the powder lubricating valve 96. An output from the control 250 on lead 258 actuates the parallel jaw gripper pneumatic actuator 111. An output on lead 259 from the control is connected to the ejector cylinder 141 to actuate the ejector mechanism. An output on lead 260 is supplied to the conveyor motor 172 which drives the conveyor 171.

It is to be realized that the control 250 intermittently drives the mold plate 17 so that it is moved relative to the various stations 11, 12, 13, 14, 16. The locking mechanism 18 locks the mold plate 17 in fixed positions such that the wet powder can be supplied by station 11 after which the mold plate 17 moves to the molding station 12 which is then actuated to supply the wet powder into the openings 41 in the mold plate 17. Subsequently, the mold plate is rotated by motor 26 so that the lubricating powder station 13 provides lubricating powder to each side of the mold plate 17 to lubricate the ends of the wet powder in the mold plate 17. Then the mold disk is moved by the motor 26 to the beveling station 14 where it is locked by the locking means 18 until the beveling punches have beveled both ends of the tablets. Then the locking means 18 is unlocked and the motor 26 drives the mold plate to the eject station 16 where the plate 17 is again locked by the locking means 18 and the eject mechanism 16 ejects the tablets onto the conveyor 171. It is to be realized, of course, that each set of openings 41 are aligned with one of the stations 11, 12, 13, 14 and 16 and that the stations are simultaneously actuated so as to continuously process tablets as the mold plate 17 is rotated. For example, in FIG. 1 six sets of openings 41 are illustrated for tablets of which five of the sets of openings are beneath the stations 11, 12, 13, 14 and 16, respectively. In the next step of operation, the mold plate will be unlocked by the locking means 18 and rotated 1/6 of the revolution so that each set of plates will be moved to the next location in a clockwise direction relative to FIG. 1 so that the machine operates as a continuous process.

It is seen that the present invention provides a novel automatic machine for forming triturate tablets and although the invention has been described with respect to preferred embodiments, it is not to be so limited as changes and modifications can be made which are within the full intended scope of the invention as defined by the appended claims.

I claim as our invention:

1. A triturate tablet machine for making bevelled triturate tablets comprising, a frame, a table formed with a plurality of tablet holes rotatably supported by said frame, a driving means connected to said table for intermittently rotating said table, a wet triturate station mounted on said frame having means for supplying wet triturate material onto said table, a molding station mounted on said frame adjacent said wet triturate station and having means for pressing said wet triturate material into some of said plurality of tablet holes of said table, a powder station mounted on said frame adjacent said molding station and having means for distributing lubricating powder over both ends of said wet triturate material in said plurality of holes, a beveling station mounted on said frame adjacent said powder station and having means including upper and lower beveling punches which engage the powdered wet triturate material in said holes to bevel said powdered wet triturate material, and an ejector station mounted on said frame between said wet triturate station and said beveling station and having means including ejectors for ejecting the bevelled triturate tablets from the holes in said table.

2. A triturate tablet machine according to claim 1 including a conveyor mounted on said frame adjacent said ejector station so as to receive said bevelled triturate tablets and convey them away from said table.

3. A triturate tablet machine according to claim 1 including a control connected to said driving means, said wet triturate station, said molding station, said powder station, said bevelling station and said ejector station to control them.

4. A triturate tablet machine according to claim 3 including an indexing means mounted on said frame and connected to said control and engageable with said table so as to periodically lock said table in selected angular positions when said wet triturate, molding, powder, bevelling and ejector stations are actuated.

5. A triturate tablet machine according to claim 1 including a first wiper arm mounted on said frame between said powder station and said beveling station and moveable to engage said beveling punches to clean them.

6. A triturate tablet machine according to claim 5 including a second wiper arm mounted on said frame between said ejector station and said wet triturate station and moveable to engage said ejectors.

7. A triturate tablet machine according to claim 1 wherein said wet triturate station comprises a hopper, an agitator driven by an agitator motor mounted within said hopper, a powder shuttle movably to receive wet triturate from said hopper and to supply wet triturate to said table and means for moving said powder shuttle from a position beneath said hopper to a position over said tablet holes in said table so as to supply wet triturate to said tablet holes.

8. A triturate tablet machine according to claim 1 wherein said molding station includes a tablet molding spreader which is rotatable and has a cup which is vertically moveable relative to said table so as to place wet triturate material in said holes of said table, and driving means for rotating said molding spreader, and means for moving said cup vertically.

9. A triturate tablet machine according to claim 1 wherein said powder station includes a lubricating powder supply means and an air supply for blowing lubricating powder from said lubricating powder supply means to said table so as to lubricate the ends of the wet triturate material which is in the holes in said table.

10. A triturate tablet machine according to claim 9 wherein said powder station includes a releasing powder containing shoe with a wedge through which a portion of said table passes and said lubricating powder is released within said shoe.

11. A triturate tablet machine according to claim 1 wherein said beveling station includes means for driving said upper and lower beveling punches toward and away from each other so as to bevel the triturate tablets in the holes of said table.

12. A triturate tablet machine according to claim 1 wherein said ejector station includes a drive means connected to said ejectors to move them into the holes in said table so as to eject the bevelled triturate tablets.

13. A triturate tablet machine according to claim 3 including a table locking and indexing means mounted on said frame and engageable with said table to intermittently lock it, and said control connected to said locking and indexing means.

* * * * *